US006992472B2

(12) United States Patent
Schimper

(10) Patent No.: US 6,992,472 B2
(45) Date of Patent: Jan. 31, 2006

(54) CIRCUIT AND METHOD FOR SETTING THE OPERATION POINT OF A BGR CIRCUIT

(75) Inventor: Markus Schimper, Moosinning (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 11/045,210

(22) Filed: Jan. 28, 2005

(65) Prior Publication Data

US 2005/0136862 A1 Jun. 23, 2005

Related U.S. Application Data

(63) Continuation of application No. PCT/DE02/02147, filed on Jun. 27, 2003.

(30) Foreign Application Priority Data

Aug. 13, 2002 (DE) ..... 102 37 122

(51) Int. Cl.
*G05F 3/16* (2006.01)

(52) U.S. Cl. ..... 323/313

(58) Field of Classification Search ..... 323/312, 323/313, 314, 315, 316
See application file for complete search history.

(56) References Cited

U.S. PATENT DOCUMENTS

| | | | | |
|---|---|---|---|---|
| 5,087,830 | A | 2/1992 | Cave et al. | |
| 5,629,611 | A * | 5/1997 | McIntyre | 323/313 |
| 5,867,013 | A | 2/1999 | Yu | |
| 6,016,051 | A * | 1/2000 | Can | 323/315 |
| 6,204,654 | B1 * | 3/2001 | Miranda et al. | 323/316 |
| 6,255,807 | B1 * | 7/2001 | Doorenbos et al. | 323/314 |
| 6,346,848 | B1 | 2/2002 | Shkap | |
| 6,630,859 | B1 * | 10/2003 | Wang | 327/539 |

FOREIGN PATENT DOCUMENTS

EP 1 063 578 B1 9/2002

* cited by examiner

*Primary Examiner*—Adolf Berhane
(74) *Attorney, Agent, or Firm*—Brinks Hofer Gilson & Lione

(57) ABSTRACT

A circuit for setting the operating point of a BGR circuit is disclosed. In the circuit, a voltage comparator (P5, P6, I3) compares the output voltage of an operational amplifier of the BGR circuit with the voltage dropping across an auxiliary circuit branch (R5, D3). The auxiliary circuit branch (R5, D3) resembles the arrangement of a circuit branch (R3, D1) of the BGR circuit, and a current source (P8) generates as a function of the result of the comparison a setting current that is fed into an input of the operational amplifier.

14 Claims, 5 Drawing Sheets

CIRCUIT AND METHOD FOR SETTING THE OPERATION POINT OF A BGR CIRCUIT

PRIORITY

This application is a continuation of pending international application PCT/DE03/02147, filed on Jun. 27, 2003, which claims the benefit of priority to German Patent Application DE 102 37 122.9, filed Aug. 13, 2002, both which are herein incorporated by reference in their entirety.

FIELD

The present application relates to a circuit and a method by means of which the operating point of a BGR circuit can be set.

BACKGROUND

Circuits that generate a constant output voltage independent of fluctuations in temperature and supply voltage are required in multifarious ways in semiconductor circuit engineering. They are used across the board in analog, digital and mixed analog/digital circuits. A frequently used type of such circuits are the so-called BGR (Bandgap Reference) circuits.

The basic principle of a BGR circuit is to add two partial signals (voltages or currents) that exhibit an opposite temperature characteristic. Whereas one of the two partial signals drops with increasing temperature, the other partial signal rises with increasing temperature. An output voltage that is temperature-constant over a certain range is then derived from the sum of the two partial signals. The output voltage of a BGR circuit is also denoted as reference voltage below in accordance with customary usage.

A stable operating point of a BGR circuit is situated at a Bandgap voltage of 1.211 V. This reference voltage can be converted into yet other voltages by means of a voltage divider. A BGR circuit can have a further stable operating point at 0 V depending on the offset of an operational amplifier used for the BGR circuit and on leakage current. Situated between the two stable operating points is an unstable operating point. This unstable operating point is in the vicinity of 0 V in the case of small leakage currents and small offset voltages. When starting the BGR circuit, the BGR circuit must be brought from the stable operating point at 0 V to the higher stable operating point that is derived from the Bandgap voltage of 1.211 V. An additional start-up circuit is generally used for this purpose.

In order to set the higher operating point in the BGR circuit, an external setting current is frequently fed into the BGR circuit. This setting current must be switched off completely during normal operation of the BGR circuit.

During the introduction of new technologies, which are not stable at high volumes, the unstable operating point can be displaced by several 100 mV toward positive voltages because of impaired offset and leakage current properties. If the switch-off point of the external setting current is subjected to high fluctuations because of a strong dependence on process and matching, the switch-off points must be selected to be so low when developing the BGR circuit that the BGR circuit is not influenced by the setting current during normal operation. However, a low switch-off point can lead to problems in the BGR circuit, since it may be that the unstable operating point is reached instead of the higher stable operating point.

Therefore, when setting the higher stable operating point the starting performance of the BGR circuit is monitored so that the switch-off point of the setting current can be determined as accurately as possible. Two modes of procedure are known for this purpose. Firstly, the output voltage of the BGR circuit can be monitored. Secondly, the current in a BGR cell can be measured.

The determination of the current through the BGR cell has proved to be the better of the two modes of procedure, since the switch-off point can be set to 1/100, 1/10 or 1/2 of the operating current of the BGR cell. The switch-off point is set to 1/4 of the operating current of the BGR cell in order to design as robustly as possible a circuit that serves for setting the operating point of the BGR circuit and for subsequently switching off the setting current.

When connecting a resistive load to the BGR circuit, it is to be ensured that a large portion of the output current flows into the load and not through the BGR cell. Consequently, the output current of the BGR circuit is not suitable in this case for determining the current in the BGR cell.

A BGR circuit with a setting circuit for setting the operating point of the BGR circuit is described in European patent application EP 1 063 578 A1. For this purpose, the reference voltage generated by the BGR circuit is compared with a voltage that is situated in a voltage range between the desired operating point and a metastable operating point. Other BGR circuits with associated setting circuits for setting the operating point of the BGR circuit are to be found in US patents U.S. Pat. No. 5,087,830 A, U.S. Pat. No. 6,346,848 B1 and U.S. Pat. No. 5,867,013 A.

FIG. 1 illustrates a known BGR circuit 1 and setting circuit 2. The BGR circuit 1 has an operational amplifier OP1, resistors R1, R2, R3 and R4, and diodes D1 and D2. Here, resistors R1, R2 and R3 as well as the diodes D1 and D2 are assigned inside the BGR circuit 1 to a BGR cell 3.

The resistors R2 and R1 as well as the diode D2 are arranged serially in the specified sequence. One end of this series circuit is connected to the output of the operational amplifier OP1, and the other end is connected to ground VSS. In the same way, the resistor R3 and the diode D1 are connected in series and connected to the output of the operational amplifier OP1 and to ground VSS.

The connecting line between the resistors R1 and R2 is connected to the inverted input of the operational amplifier OP1. The connecting line between the resistor R3 and the diode D1 is connected to the non-inverted input of the operational amplifier OP1 via a further connecting line. An additional current Iein can be coupled into this further connecting line. A resistor R4 is also connected between the output of the operational amplifier OP1 and ground VSS.

The output of the operational amplifier OP1 also constitutes the output of the BGR circuit 1. A temperature-stabilized reference voltage can be tapped at the output of the BGR circuit 1 during its normal operation. The temperature stability of the reference voltage is based on the opposite nature of the temperature dependencies of the two voltages that drop across the resistor R3 and across the diode D1, respectively. The diode D1 and the diode D2 can be constructed in each case, for example, from a bipolar transistor whose base terminal is connected to its collector terminal. The base/emitter voltage of the diode D1 then has, for example, a temperature coefficient of −2 mV/K. The temperature dependence of the voltage dropping across the resistor R3 is a function of the dimensioning of the resistors R1, R2 and R3, and of the temperature coefficients of the thermal voltage VT of the diode D2. The voltage dropping across the resistor R3 has a temperature coefficient of +2 mV/K, owing to a suitable selection of these components and because of the design of the BGR circuit 1 in terms of circuit engineering. This results overall in a reference voltage that is stable over a certain temperature range.

The setting circuit 2 is connected downstream of the BGR circuit 1. The setting circuit 2 comprises transistors N1, N2, P1, P2, P3 and P4, as well as a constant current source I1. The transistors N1, N2, P1, P2, P3 and P4 are MOSFETs. The respective doping of their channels is specified by the letters N and P respectively, in their reference symbols. This nomenclature also applies to transistors mentioned below.

The transistors N1 and N2 are connected in a current mirror circuit downstream of the input of the setting circuit 2. Flowing in this case through the transistor N1 is the input current of the setting circuit 2, which is at the same time the output current of the BGR circuit 1. The mirrored input current flows through the transistor N2 into the transistor P1, which is connected, in turn, to the transistor P2 in a current mirror circuit. The transistor P2 is also included in a differential amplifier stage that also comprises the transistor P3 and the constant current source I1. Here, the constant current source I1 is connected to the drain/source paths of the transistors P2 and P3. The transistors P3 and P4 form a further current mirror. The transistor P4 generates the current Iein that is coupled into the BGR circuit 1 from the setting circuit 2.

The function of the circuit arrangement as shown in FIG. 1 is as follows. The setting circuit 2 may be used to replicate in the transistor N1 the current flowing through the resistor R3 and the diode D1. For this purpose, the transistors N1 and N2 are set via their W/L ratio such that their steepness gm corresponds to the resistor R3. However, the resistor R3 and the steepness gm do not match because of fluctuations in the production process and different temperature coefficients. By contrast, the diode D1 has a similar temperature response and current response to those of the thermal voltage VT of the transistors N1 and N2. The arrangement shown in FIG. 1 thus yields only an inaccurate replication of the current flowing in the BGR cell 3 through the resistor R3 and the diode D1.

The current flowing through the transistor N1 is mirrored into the differential amplifier stage by means of the current mirror circuits constructed from the transistors N1 and N2 and, respectively P1 and P2. The current generated in the differential amplifier stage by the constant current source I1 is the minimum current that must flow through the transistor N1. If the current flowing through the transistor N1 is smaller than this minimum current, the differential amplifier stage causes the differential current of these two currents to flow through the drain/source path of the transistor P3. The current Iein is yielded as mirror image of the differential current by means of the current mirror constructed from the transistors P3 and P4.

The current Iein is coupled into the BGR circuit 1 at the non-inverting input of the operational amplifier OP1 and flows away there to ground VSS via the diode D1. As a result, the current Iein generates via the diode D1 a voltage drop that results, in turn, in a positive potential difference between the inputs of the operational amplifier OP1. The operational amplifier OP1 increases its output voltage because of the positive potential difference at its inputs.

The setting circuit 2 is designed such that the current Iein is switched off as soon as there is enough current flowing in the BGR cell 3 that it is possible to reach only the stable operating point of the BGR circuit 1. The current generated by the constant current source I1 in this case prescribes when the current Iein is switched off. The constant current source I1 can be constructed, for example from a resistor and a diode, or from a PTAT (Proportional to Absolute Temperature) generator.

BRIEF SUMMARY

Accordingly, a circuit for setting the operating point of a BGR circuit is provided that has a high precision and a simple topology. A corresponding method is also provided. In addition to the BGR circuit, which can be used to generate a temperature-stabilized reference voltage, the circuit has a setting circuit.

By way of introduction only, in one embodiment the BGR circuit includes an operational amplifier from whose output voltage the reference voltage is to be derived, and a BGR circuit branch with two components. The temperature dependencies of the two components are opposed during operation of the BGR circuit. These can be, in particular, the temperature dependencies of the voltages respectively dropping across the components. One input of the operational amplifier is connected to the BGR circuit branch via a connecting line. The output voltage that can be tapped at the output of the operational amplifier drops across the BGR circuit branch.

The setting circuit in one embodiment includes a voltage comparator, an auxiliary circuit branch, a first current source and a second current source. The auxiliary circuit branch has the same components in the same arrangement as the BGR circuit branch. The first current source feeds the auxiliary circuit branch. The voltage comparator compares the output voltage of the operational amplifier with the voltage that drops across the auxiliary circuit branch. The second current source generates a setting current as a function of this comparison, and thereby feeds the connecting line.

The circuit enables the setting of the operating point of the BGR circuit by coupling in the setting current. The setting current is generated using the voltage comparison.

During the voltage comparison, the voltage dropping across the BGR circuit branch is compared with the voltage dropping across the auxiliary circuit branch. The voltage dropping across the auxiliary circuit branch is produced by the current generated by the first current source in the auxiliary circuit branch. Since the auxiliary circuit branch is an exact simulation of the BGR circuit branch, the voltage comparison also constitutes a comparison of the current flowing through the BGR circuit branch with the current generated by the first current source. The result of the comparison determines the magnitude of the setting current. The setting current generates a voltage difference at the inputs of the operational amplifier, and thereby causes the operational amplifier to change its output voltage accordingly.

Moreover, the circuit also permits the setting current to be switched off. If the voltage comparison delivers a specific result, it can be provided that the switch-off point is reached, and that the setting current is accordingly switched off. This may be the case when the output voltage of the operational amplifier is as large as or larger than the voltage dropping across the auxiliary circuit branch. This means that the switch-off point is determined by the magnitude of the current generated by the first current source.

The BGR circuit branch in one embodiment has a resistor and a downstream diode. The diode may be constructed in particular from a transistor whose base terminal or gate terminal is connected to its collector/emitter path or to its drain/source path. The connecting line between the BGR circuit branch and the input of the operational amplifier is arranged between the resistor and the diode. In accordance with the design of the circuit, the auxiliary circuit branch likewise has a resistor and a series-connected diode.

The connecting line may be coupled on the side of the operational amplifier to its non-inverting input. Since ideally no current flows through the inputs of an operational amplifier, the setting current flows off via the BGR circuit branch and, in particular, via the diode.

In one embodiment, the voltage comparator is a differential amplifier with a third current source and first and second transistors. The output voltage of the operational amplifier is present at the first transistor, and the voltage dropping across the auxiliary circuit branch is present at the second transistor. The differential amplifier constitutes a simple and cost-effective voltage comparator.

In one embodiment, the differential amplifier is dimensioned such that if the output voltage of the operational amplifier is lower than the voltage dropping across the auxiliary circuit branch, the current generated by the third current source flows substantially through the first transistor. A first current mirror may be connected downstream of the first transistor.

A current generated by a fourth current source can be coupled between the first transistor and the first current mirror. In one embodiment, the current generated by the fourth current source has half the value of the current generated by the third current source. This permits the setting current to be switched off even more abruptly.

Alternatively, a second current mirror may be provided. In this case, the second current mirror is fed on the input side from the second transistor and is connected on the output side to the gate or base terminals of the first current mirror. This likewise permits the setting current to be switched off as abruptly as possible.

The second current source may include at least one third current mirror, whose input current comes from the comparison carried out by the voltage comparator, and whose output current is the setting current. The first current source can, for example, be constructed from a resistor and a diode, or from a PTAT (Proportional to Absolute Temperature) generator.

The above circuit can be used when starting the BGR circuit, for example from the switched-off state.

The method in one embodiment serves for setting the operating point of a BGR circuit which generates a temperature-stabilized reference voltage. The BGR circuit has an operational amplifier and a BGR circuit branch. The BGR circuit branch comprises two components whose temperature dependencies are opposed during operation of the BGR circuit. These temperature dependencies can be, in particular, the temperature dependencies of the voltages respectively dropping across the components. One input of the operational amplifier is connected to the BGR circuit branch via a connecting line. The output voltage that can be tapped at the output of the operational amplifier drops across the BGR circuit branch. In normal operation of the BGR circuit, the aim is for the reference voltage to be obtained from the output voltage of the operational amplifier.

An auxiliary voltage is first generated. The auxiliary voltage drops across an auxiliary circuit branch that resembles the BGR circuit branch in its arrangements and dimensions. The output voltage is compared with the auxiliary voltage. A setting current is generated as a function of the result of the comparator and the setting current is fed into the connecting line. The setting current may be generated only when the output voltage of the operational amplifier is lower than the auxiliary voltage.

The method can be used to set the operating point of the BGR circuit with high precision and with a very low outlay. The method also permits the setting current to be shut down again when normal operation of the BGR circuit is stopped.

The foregoing summary has been provided only by way of introduction. Nothing in this section should be taken as a limitation on the following claims, which define the scope of the invention.

DETAILED DESCRIPTION OF THE EMBODIMENTS

Figure 1:
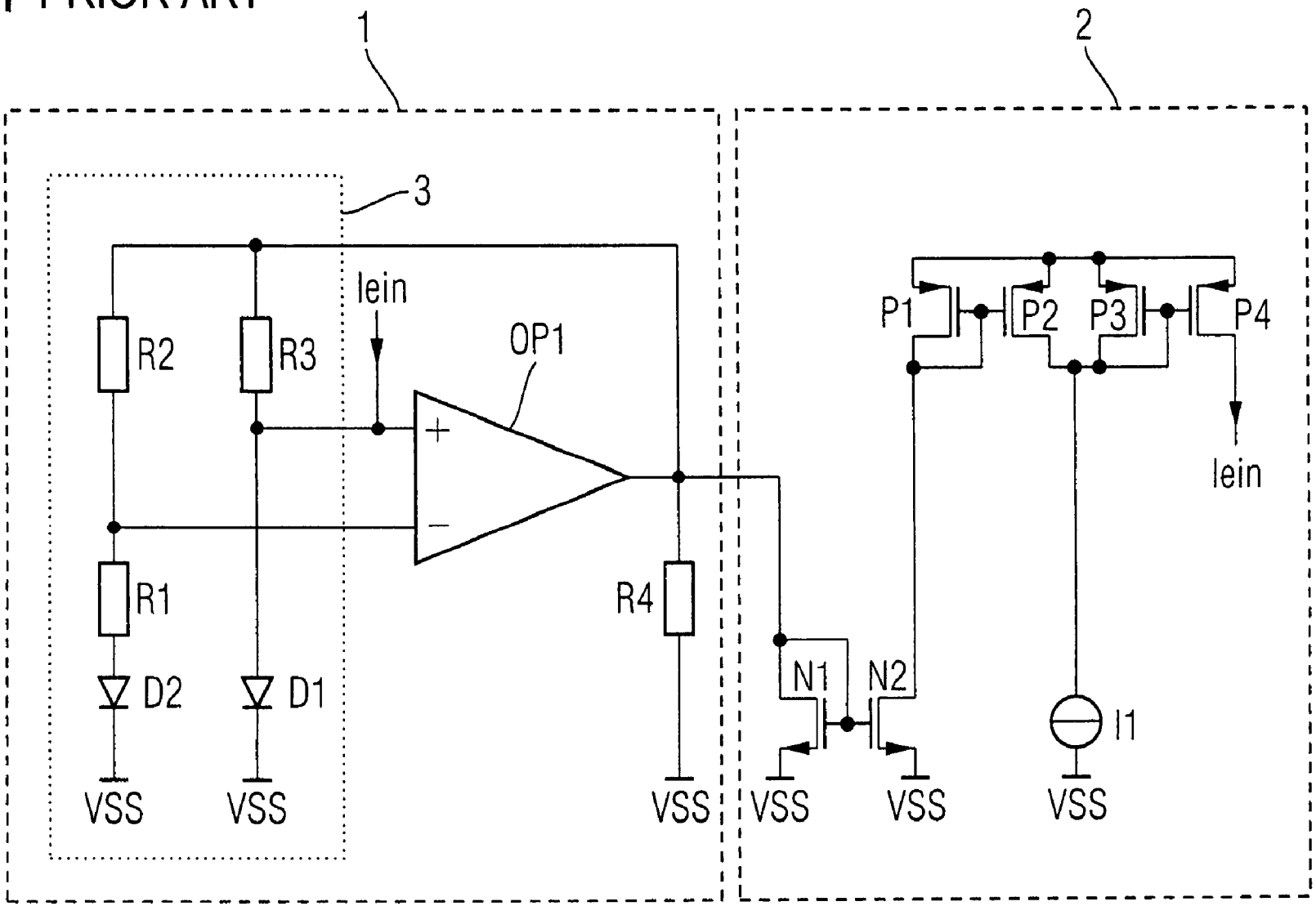
FIG 1 PRIOR ART
FIG. 1 shows a circuit diagram of a BGR circuit and a setting circuit from the prior art.
Figure 2:
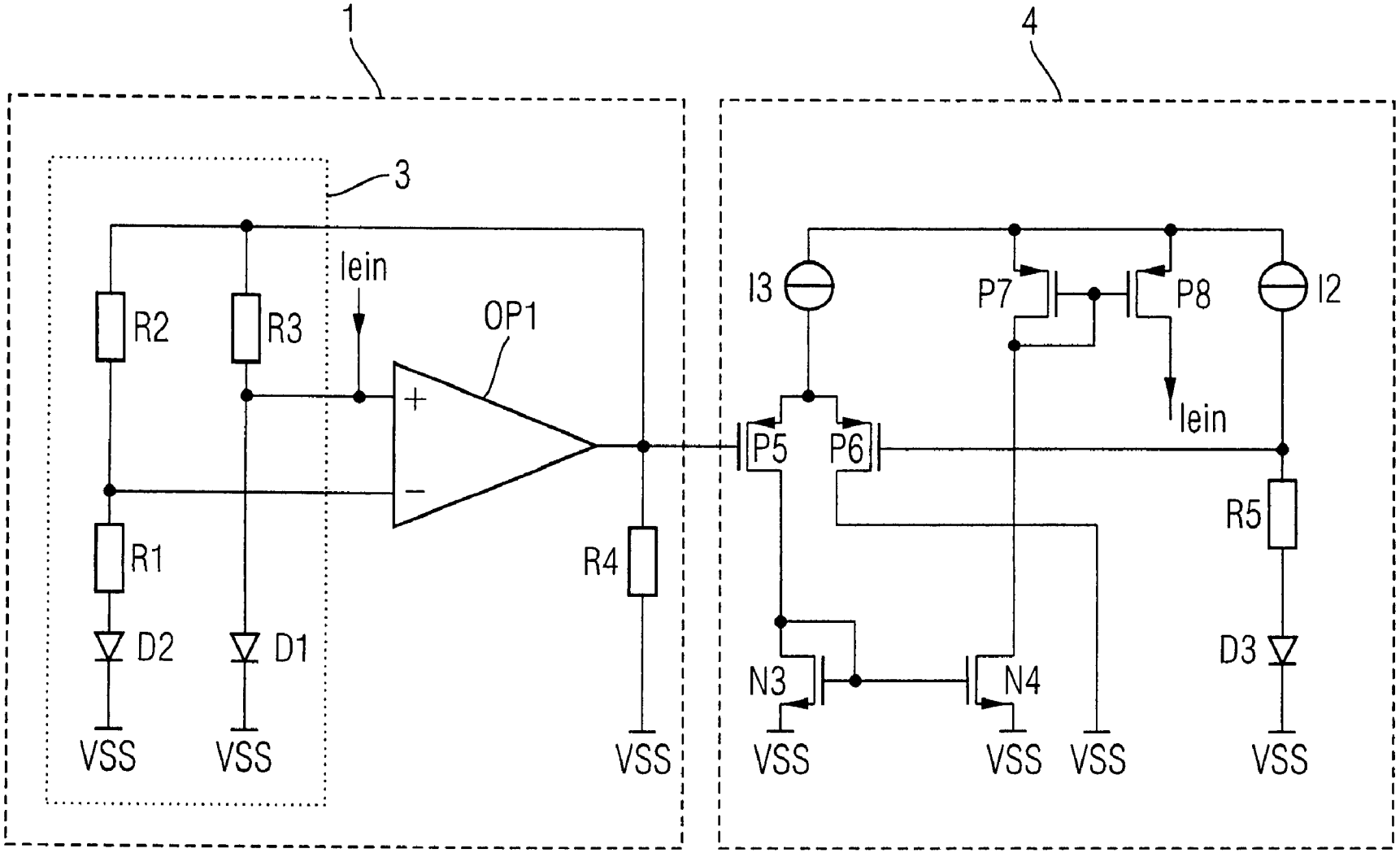
FIG. 2 shows a circuit diagram of a first embodiment of the circuit according to the invention.

FIG. 2 illustrates a first embodiment including the BGR circuit 1, already shown in FIG. 1, and a setting circuit 4. The BGR circuits 1 of FIGS. 1 and 2 are identical. Consequently, identical components in FIGS. 1 and 2 have the same reference symbols.

The setting circuit 4 has a resistor R5, a diode D3, transistors N3, N4, P5, P6, P7 and P8, as well as constant current sources I2 and I3. The input of the setting circuit 4 is connected to the output of the BGR circuit 1. Connected downstream of the input of the setting circuit 4 is a differential amplifier stage that comprises the constant current source I3 and the transistors P5 and P6. Connected downstream of the drain/source path of the transistor P5 is a current mirror circuit with the transistors N3 and N4. The drain/source path of the transistor N4 is a current mirror circuit constructed from the transistors P7 and P8. This current mirror circuit generates in the drain/source path for the transistor P8 the setting current Iein that, like the circuit arrangement shown in FIG. 1, is fed into the BGR circuit 1 at the non-inverting input of the operational amplifier OP1.

The resistor R5 and the diode D3 are connected in series. This series circuit is fed on the side of the resistor R5 from the constant current source I2, and the series circuit is connected to ground VSS on the side of the diode D3. The connection between the resistor R5 and the constant current source I2 is connected to the gate terminal of the transistor P6.

The resistor R5 and the diode D3 of the setting circuit 4 are respectively of the same design as the resistor R3 and the diode D1. Consequently, the series circuit constructed from the resistor R5 and the diode D3 has the same design as the right-hand circuit branch of the BGR cell 3. A current generated by the constant current source I2 flows through the series circuit constructed from the resistor R5 and the diode D3. This current flow generates a voltage drop across the series circuit. The voltage dropping across the corresponding series circuit in BGR circuit 1 is equal to the output voltage of the operational amplifier OP1. Since this voltage is simultaneously the output voltage of the BGR circuit 1, the voltage dropping across the resistor R3 and the diode D1 can be compared by means of the differential amplifier stage with the voltage dropping across the resistor R5 and the diode D3.

A current flows through the transistors P5 or P6 as a function of the comparison described above. If the voltage present at the output of the BGR circuit 1 is lower than the voltage dropping across the resistor R5 and the diode D3, the current denoted by the constant current source I3 flows through the drain/source path of the transistor P5. By means of the current mirror circuits constructed from the transistors N3 and N4 or, respectively, P7 and P8, this current generates the current Iein. The current Iein acts in the BGR circuit 1 as has already been explained in the description relating to FIG. 1.

If the voltage present at the output of the BGR circuit 1 is higher than the voltage dropping across the resistor R5 and the diode D3, the current generated by the constant current source I3 flows away through the drain/source path of the transistor P6 to ground VSS. In this case, no current flows through the transistor P5, and the current Iein is switched off.

One advantage of the setting circuit 4 shown in FIG. 2 over the setting circuit 2 shown in FIG. 1 is that a true simulation of the right-hand circuit branch of the BGR cell 3 is used in the setting circuit 4. The simulation in the setting circuit 4 renders it possible to set the switch-off point of the current Iein precisely when setting the operating point of the BGR circuit 1. The switch-off point thus accurately defined permits the current Iein generated by the setting circuit 4 to be switched off at substantially higher current values than the current Iein generated by the setting circuit 1. This guarantees that the higher stable operating point of the BGR circuit 1 is reached, and that the current Iein does not disturb the normal operation of the BGR circuit 1.

Figure 3:
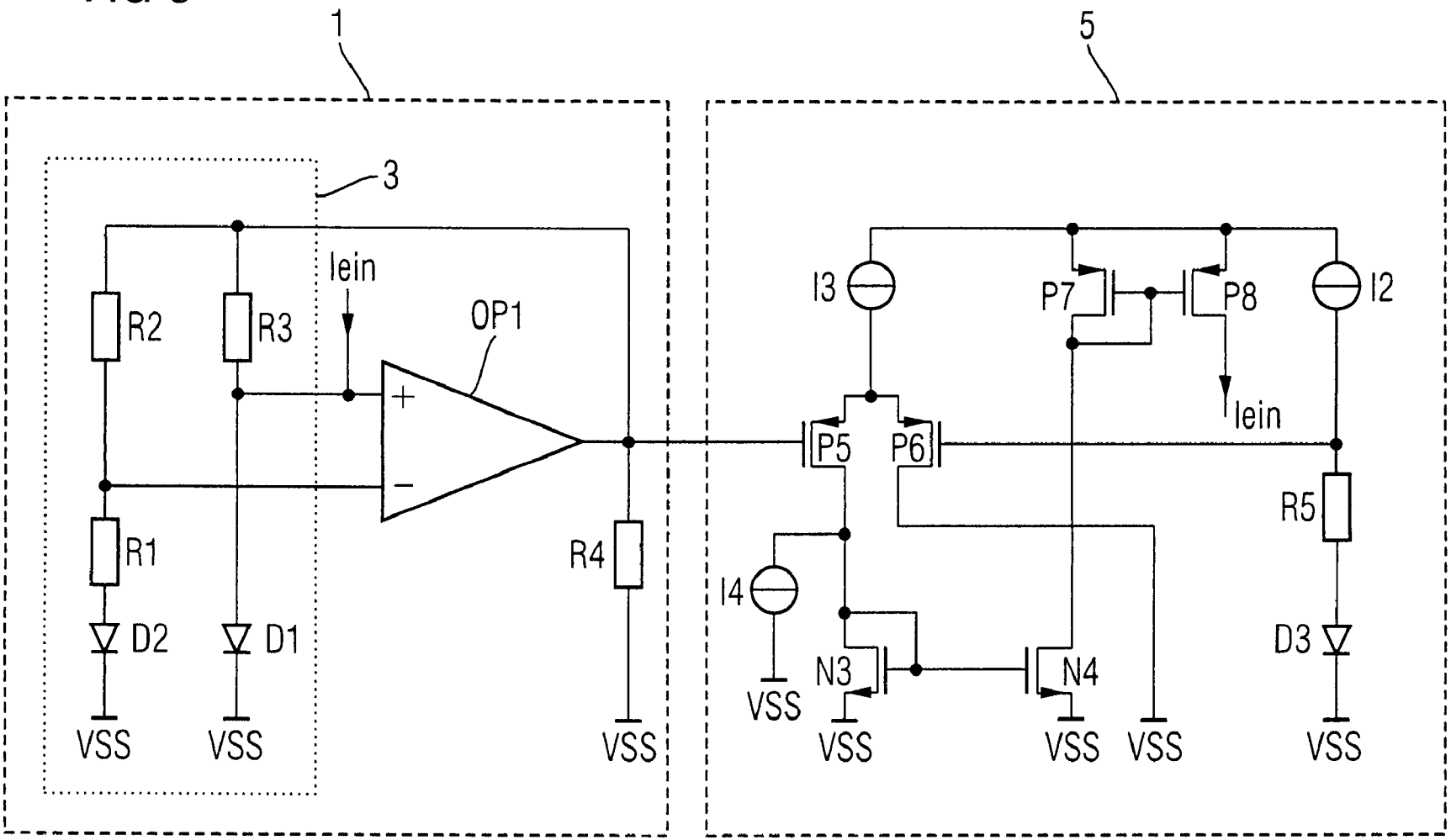
FIG. 3 shows a circuit diagram of a second embodiment of the circuit according to the invention.
Figure 4:
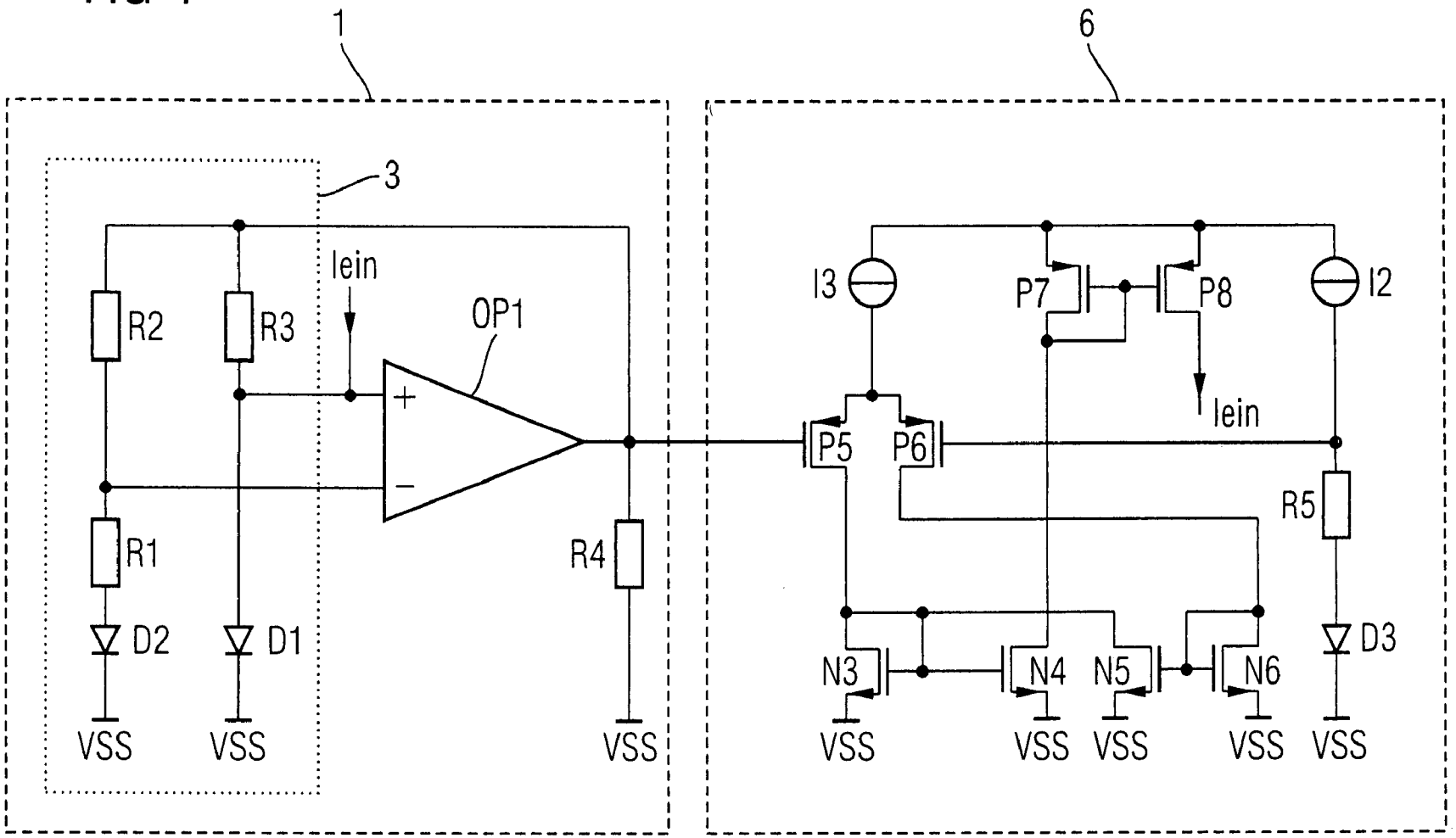
FIG. 4 shows a circuit diagram of a third embodiment of the circuit according to the invention.
Figure 5:
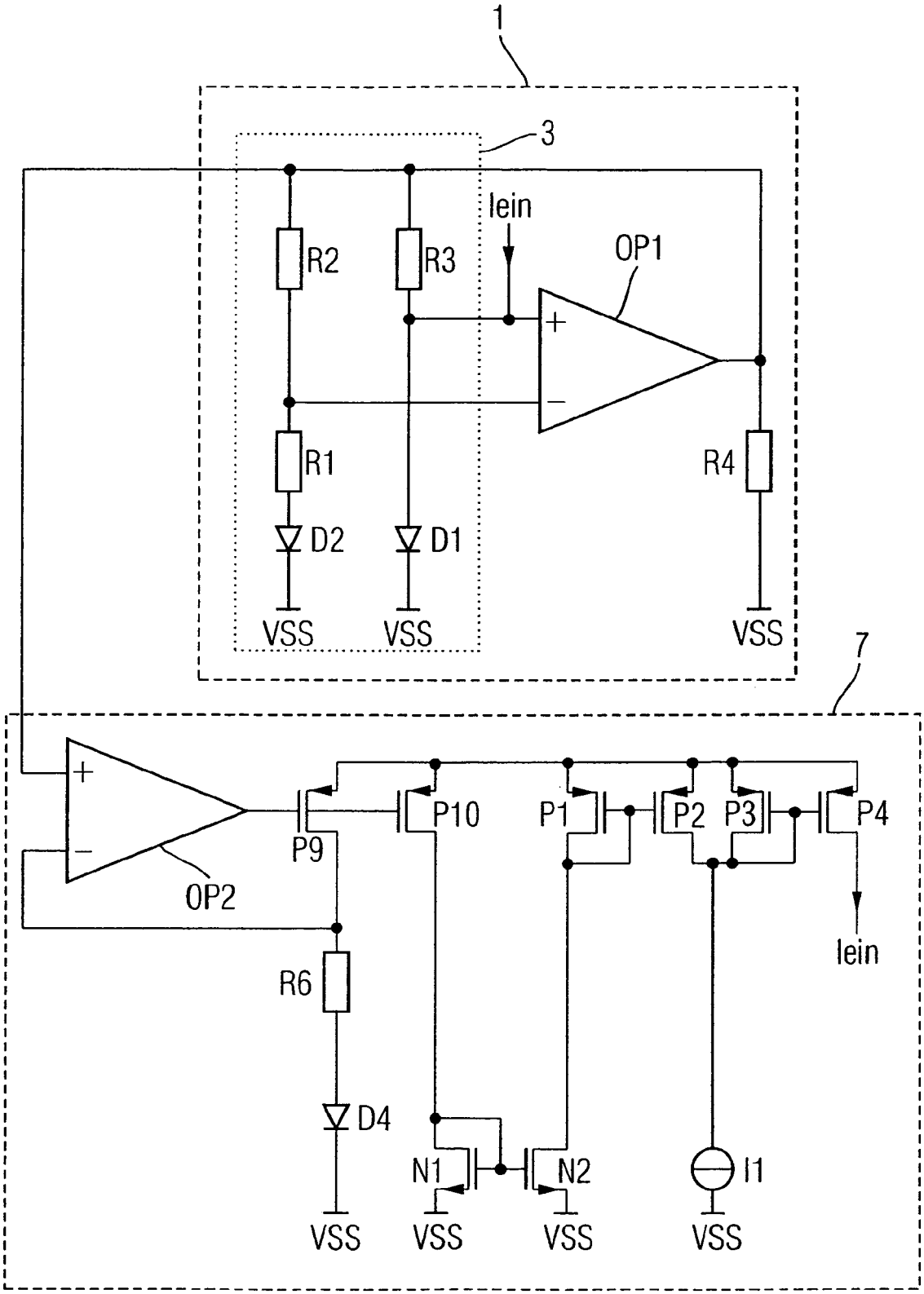
FIG. 5 shows a circuit diagram of the BGR circuit with a further setting circuit.

Shown in FIGS. 3–5 are second, third, and fourth embodiments of the setting circuits 5, 6 and 7.

In contrast to the setting circuit 4, the setting circuit 5 in FIG. 3 includes an additional constant current source I4. The current generated by the constant current source I4 is coupled into one branch of the differential amplifier stage between the transistors P5 and N3. In this embodiment, the current generated by the constant current source I4 has half the value of the current generated by the constant current source I3. The coupling in of the additional current permits the current Iein to thereby be switched off even more abruptly in comparison to the setting circuit 4.

The setting circuit 6 shown in FIG. 4 includes an additional current mirror circuit constructed from transistors N5 and N6. In this case, the transistor N6 is connected as a diode and is fed from the transistor P6. The drain/source path of the transistor N5 is connected to the gate terminals of the transistors N3 and N4.

The setting circuit 7 shown in FIG. 5, in contrast to the setting circuit 2, contains an operational amplifier OP2, transistors P9 and P10, and a resistor R6 and a diode D4 connected downstream of the input of the setting circuit 7. The non-inverting input of the operational amplifier OP2 is coupled to the output of the BGR circuit 1. The inverting input of the operational amplifier OP2 is connected to a terminal of the resistor R6. Connected to the other terminal of the resistor R6 is the diode D4 which, in turn, is connected to ground VSS with its second terminal.

Like the resistor R5 and the diode D3 from FIGS. 2 to 4, the resistor R6 and the diode D4 constitute exact simulations of the resistor R3 and the diode D1.

The gate terminals of the transistors P9 and P10 are connected to the output of the operational amplifier OP2. The drain/source path of the transistor P9 or P10 feeds the resistor R6 or the transistor N1, respectively.

In the setting circuit 2, because of the resistive connection of the output of the BGR circuit 1, the current in the BGR cell 3 may not be measured exactly using the setting circuit 2. The setting circuit 5 avoids this by using the operational amplifier OP2 as voltage/current converter. In this case, the operational amplifier OP2 compares the voltages present at its inputs, and sets its output voltage correspondingly. On the basis of the downstream transistors P9 and P10, the output voltage generates two currents of which one feeds the simulation of the right-hand circuit branch of the BGR cell 3, and the other feeds the transistor N1. Because of this circuit arrangement, the current flowing through the resistor R6 and the diode D4 has the same current value as the current flowing through the right-hand circuit branch of the BGR cell 3. The same also holds for the current flow through the transistor N1. The circuit arrangement connected downstream of the transistor N1 is identical to the circuit arrangement of the setting circuit 2.

As shown and described, in various embodiments, the switch-off point of the current Iein is determined either by means of a comparison in which the output voltage of the BGR circuit 1 is compared with the voltage generated by the constant current source I2, across the simulation of the right-hand circuit branch of the BGR cell 3, or by replicating the current through the BGR cell 3 and defining the switch-off point with the aid of the replicated current.

It is therefore intended that the foregoing detailed description be regarded as illustrative rather than limiting, and that it be understood that it is the following claims, including all equivalents, that are intended to define the spirit and scope of this invention. Other variations may be readily substituted and combined to achieve particular design goals or accommodate particular materials or manufacturing processes.

What is claimed is:

1. A circuit comprising:

a BGR (Bandgap Reference) circuit having an operating point and that generates a temperature-stabilized reference voltage, the BGR circuit having:

an operational amplifier from whose output voltage the reference voltage is derived, and a BGR circuit branch with two components whose temperature dependencies are opposed during normal operation of the BGR circuit, an input of the operational amplifier connected via a connecting line to the BGR circuit branch, and the output voltage that can be tapped at an output of the operational amplifier dropping across the BGR circuit branch; and a setting circuit that sets the operating point of the BGR circuit, the setting circuit having:

a voltage comparator, an auxiliary circuit branch with two components that are arranged exactly and have the same dimensions as the two components of the BGR circuit branch, the voltage comparator comparing the output voltage of the operational amplifier with a voltage dropping across the auxiliary circuit branch, a first current source that feeds the auxiliary circuit branch, and a second current source that generates, as a function of the result of the comparison, a setting current that is fed into the connecting line.

2. The circuit as claimed in claim 1, wherein the setting current is generated only if the output voltage is lower than the voltage dropping across the auxiliary circuit branch.

3. The circuit as claimed in claim 1, wherein the BGR circuit branch and the auxiliary circuit branch each include a resistor and a downstream diode that is constructed from a transistor.

4. The circuit as claimed in claim 1, wherein the connecting line is coupled to a non-inverting input of the operational amplifier.

5. The circuit as claimed in claim 1, wherein the voltage comparator is a differential amplifier with a third current source, a first transistor and a second transistor, the output voltage of the operational amplifier being present at the first transistor, and the voltage dropping across the auxiliary circuit branch being present at the second transistor.

6. The circuit as claimed in claim 5, wherein the differential amplifier is dimensioned such that if the output voltage of the operational amplifier is lower than the voltage dropping across the auxiliary circuit branch, the current generated by the third current source flows substantially through the first transistor.

7. The circuit as claimed in claim 5, wherein a first current mirror is connected downstream of the first transistor.

8. The circuit as claimed in claim 7, wherein a branch of the differential amplifier with the first transistor is fed from a fourth current source, and the current generated by the fourth current source has half the value of the current generated by the third current source.

9. The circuit as claimed in claim 7, wherein a second current mirror, which is fed on the input side from the second transistor, is connected on an output side to gate or base terminals of the first current mirror.

10. The circuit as claimed in claim 1, wherein the second current source includes at least one third current mirror, whose input current comes from the comparison carried out by the voltage comparator, and whose output current is the setting current.

11. The circuit as claimed in claim 1, wherein the first current source comprises a resistor and a diode or a PTAT (Proportional to Absolute Temperature) generator.

12. A method of using a circuit, the circuit including:

a BGR (Bandgap Reference) circuit having an operating point and that generates a temperature-stabilized reference voltage, the BGR circuit having:

an operational amplifier from whose output voltage the reference voltage is derived, and a BGR circuit branch with two components whose temperature dependencies are opposed during normal operation of the BOR circuit, an input of the operational amplifier connected via a connecting line to the BGR circuit branch, and the output voltage that can be tapped at an output of the operational amplifier dropping across the BGR circuit branch; and a setting circuit that sets the operating point of the BGR circuit, the setting circuit having:

a voltage comparator, an auxiliary circuit branch with two components that are arranged exactly and have the same dimensions as the two components of the BGR circuit branch, the voltage comparator comparing the output voltage of the operational amplifier with a voltage dropping across the auxiliary circuit branch, a first current source that feeds the auxiliary circuit branch, and a second current source that generates, as a function of the result of the comparison, a setting current that is fed into the connecting line;

the method comprising using the circuit when starting the BGR circuit.

13. A method for setting the operating point of a BGR circuit which generates a temperature-stabilized reference voltage and which has an operational amplifier from whose output voltage the reference voltage is to be derived, and a BGR circuit branch with two components whose temperature dependencies are opposed during normal operation of the BGR circuit, an input of the operational amplifier being connected via a connecting line to the BGR circuit branch, and the output voltage that can be tapped at an output of the operational amplifier dropping across the BGR circuit branch, the method comprising:

(a) generating an auxiliary voltage that drops across an auxiliary circuit branch with two components that are arranged exactly like and have the same dimensions as the two components of the BGR circuit branch;

(b) comparing the output voltage with the auxiliary voltage;

(c) generating a setting current as a function of the result of the comparison, and (d) feeding the setting current into the connecting line.

14. The method as claimed in claim 13, wherein the setting current is generated only if the output voltage is lower than the auxiliary voltage.

* * * * *

UNITED STATES PATENT AND TRADEMARK OFFICE

CERTIFICATE OF CORRECTION

PATENT NO. : 6,992,472 B2
APPLICATION NO. : 11/045210
DATED : January 31, 2006
INVENTOR(S) : Markus Schimper It is certified that error appears in the above-identified patent and that said Letters Patent is hereby corrected as shown below:

Title page Related U.S. Application Data item (63):

"PCT/DE02/02147" should read --PCT/DE03/02147--

Signed and Sealed this

Fifteenth Day of May, 2007

JON W. DUDAS
*Director of the United States Patent and Trademark Office*